US006830000B2

(12) United States Patent
Mendive et al.

(10) Patent No.: US 6,830,000 B2
(45) Date of Patent: Dec. 14, 2004

(54) AUTOMATIC FIREPOT CLEANING SYSTEM

(75) Inventors: Rich Mendive, Priest River, ID (US); Roger King, Priest River, ID (US)

(73) Assignee: Mendive Corporation, Priest River, ID (US)

( * ) Notice: Subject to any disclaimer, the term of this patent is extended or adjusted under 35 U.S.C. 154(b) by 75 days.

(21) Appl. No.: 10/406,831

(22) Filed: Apr. 4, 2003

(65) Prior Publication Data

US 2004/0194679 A1 Oct. 7, 2004

(51) Int. Cl.[7] ..... F23J 1/06

(52) U.S. Cl. ..... 110/165 R; 110/167; 110/169; 126/242

(58) Field of Search ..... 126/242; 110/168, 110/169

(56) References Cited

U.S. PATENT DOCUMENTS

| | | | | | |
|---|---|---|---|---|---|
| 2,302,197 | A | * | 11/1942 | Edwards | 236/16 |
| 2,370,246 | A | * | 2/1945 | Julyan et al. | 110/287 |
| 3,092,050 | A | * | 6/1963 | Morgan | 110/259 |
| 3,104,629 | A | * | 9/1963 | Crawford et al. | 110/191 |
| 3,837,012 | A | * | 9/1974 | Rassbach et al. | 4/111.3 |
| 4,048,928 | A | | 9/1977 | Martin | 110/165 R |
| 4,203,374 | A | | 5/1980 | Frederick | 110/258 |
| 4,384,534 | A | | 5/1983 | Lamb et al. | 110/165 R |
| 4,520,738 | A | | 6/1985 | Takehara | 110/171 |
| 4,534,301 | A | | 8/1985 | Sakash et al. | 110/255 |
| 4,624,239 | A | | 11/1986 | Yellin | 126/25 R |
| 4,625,660 | A | | 12/1986 | Brungger et al. | 110/165 R |
| 4,798,150 | A | | 1/1989 | Pressnall et al. | 110/171 |
| 4,852,504 | A | | 8/1989 | Barresi et al. | 110/346 |
| 4,884,515 | A | | 12/1989 | Falconnet | 110/171 |
| 5,000,100 | A | | 3/1991 | Mendive et al. | 110/250 |
| 5,159,884 | A | | 11/1992 | Malick | 110/223 |
| 5,582,117 | A | | 12/1996 | Mendive et al. | 110/247 |
| 5,873,356 | A | | 2/1999 | Vossler et al. | 126/110 E |
| 5,893,358 | A | * | 4/1999 | Whitfield | 126/73 |

FOREIGN PATENT DOCUMENTS

| | | | | |
|---|---|---|---|---|
| GB | 2188142 A | * | 9/1987 | F23H/13/06 |

* cited by examiner

*Primary Examiner*—Kenneth B Rinehart
(74) *Attorney, Agent, or Firm*—Pedersen & Co., PLLC; Ken J. Pedersen; Barbara S. Pedersen

(57) ABSTRACT

Embodiments are shown of a floor opening and/or closing system for pellet stoves and other solid-fuel combustion devices with ash-dumping floors. The system uses a cam system wherein a cam member automatically moves to urge the ash-dumping floor open and/or closed, preferably by means of contact with a following arm extending from or connected to the floor. Preferably, the cam member is a crank arm/lever that contacts surfaces of a cam arm in order to cause the cam arm to pivot between two positions. The cam arm is preferably connected to the ash-dumping floor by a connecting rod, so that movement of the crank arm and resultant movement of the cam arm causes movement of the floor. Adaptations may be made for manual control of the floor, for example, by providing a neutral position for the crank member, wherein the cam arm and its connecting rod may be moved independently from, and unhindered by, the crank arm.

18 Claims, 5 Drawing Sheets

AUTOMATIC FIREPOT CLEANING SYSTEM

BACKGROUND OF THE INVENTION

1. Field of the Invention

This patent relates to heating pellet stoves and other combustion devices. More particularly, this invention relates to pellet stoves with automated ash-dumping floors.

2. Related Art

Mendive, et al. (U.S. Pat. No. 5,582,117) disclose a firepot with an ash-dumping floor. The floor of the firepot pivots horizontally. Pivoting the floor-piece uncovers an opening in the bottom of the firepot's combustion chamber, and the ashes fall into the opening out of the firepot.

Current pellet stove technology requires high-grade fuels; high-ash industrial grade fuels are not available for use because stove cleanup would be required too frequently to be practical. These high-ash fuels include biodegradable wastes such as cotton stalk, wheat and straw stubble, chipped bark, brush, and many types of agricultural waste. These fuels would be cheaper for pellet stove owners, and would create markets for these biodegradable wastes, diverting them from landfills. Thus, there is a need for a system to automatically and effectively remove ash from pellet stoves and other combustion devices.

SUMMARY OF THE INVENTION

The invention is a floor opening system for pellet stoves and other combustion devices with moving, ash-dumping floors. The floor opening system comprises a cam system that automatically opens the floor, and/or closes the floor. Preferably, a cam member is movable to urge its protruding cam surface against an arm or other member that is connected to the floor, for translating the movement of the cam member into movement of the floor. The preferred cam member moves into an opening position that urges the arm to open the floor, and into a closing position that urges the arm to close the floor. The cam member may also have a neutral or "park" position, wherein the floor is manually movable to the open and/or closed position, preferably by means of the arm not being urged or contacted by the cam member, and by means of the arm not being attached to or otherwise hindered by the cam member. A motor may be used to turn/move the cam member. The invention can be used to automatically clean a stove at the end of a burn cycle and to set the time for alternating burn and clean cycles as appropriate for the fuel being used.

DETAILED DESCRIPTION OF THE INVENTION

Figure 1:
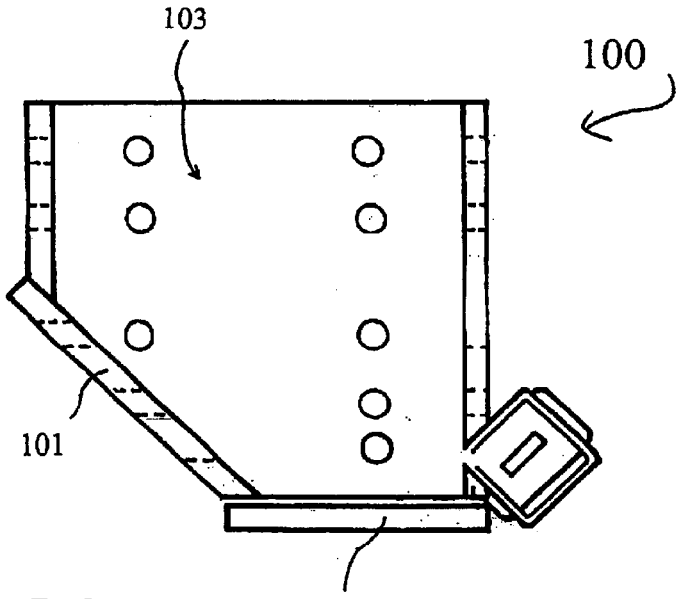
FIG. 1 is a schematic cut-out side view of one stove embodiment of a pellet stove, such as described in U.S. Pat. No. 5,582,117, which may be retrofitted with or manufactured originally with a floor opening and closing system according to the invention.

The preferred embodiment of the present invention is an improvement to stoves with ash-dumping floors, such as that of U.S. Pat No. 5,582,117, which is incorporated herein by reference. The invented stove floor opening and closing system is also capable of being adapted for any stove having a movable floor.

A pellet stove typically comprises a container surrounding a combustion chamber. In a compatible stove, the bottom of the firepot includes a movable floor. Fuel pellets are fed into the combustion chamber. One or more of the sides of the combustion chamber are preferably sloped to create one or more ramps that facilitate the movement of ashes to the movable floor.

When ash builds up in the combustion chamber, the floor is moved to permit ashes and any other burn debris resting on top of it to be dumped out of the bottom of the stove. The movable floor may extend across the entire distance from the ramp's lower end to the opposite sidewall, so that when the floor is moved aside, the ashes fall efficiently and completely out of the firepot.

When the heat demand for the room or space is satisfied, the preferred pellet delivery system stops, and the pellets already burning in the burn section are allowed to burn to ash, typically over a time period of about 8–12 minutes with an exhaust or inlet air blower on to continue efficient exhaust and to cool the ash. The movable floor then opens and dumps out the ash A, preferably into a tray (such as tray 7 in FIG. 2) or other removable receptacle below the firepot. Some ash and clinkers may tend to stick on the ramp until the vibration of the first or repeated cycles of the moving floor knocks them loose. Therefore, preferably, but not necessarily, the floor opens and closes twice, the first time being for removal of the bulk of the ash, and the second time being for removal of residue ash or clinkers that were held or lodged in the combustion chamber and then jarred loose by the first opening and closing of the floor.

The invented floor opening and/or closing system for an ash-removal floor of a stove comprises a cam system comprising a cam member and a follower or "cam arm" that is operatively connected to an ash-removal floor of a stove's combustion chamber. The cam member has a protruding or "cam" surface, movable into various positions to control the position of the cam arm. The terms "cam" or "cam member" and "follower" as used in the mechanical arts are appropriate, as the cam member has one or more portions/surfaces that protrude relative to its other portions/surfaces, so that movement of the cam member relative to the following member causes the cam member to sometimes contact, and sometimes not contact, the following member, and, hence, applies force to, and moves, the following member. In the preferred embodiment, the cam member is a rotating/swinging member, preferably an elongated arm/lever wherein the distal end of the arm/lever is the protruding portion. The cam member rotates or swings inside an opening/aperture of a cam arm, but other shapes and configurations of the cam member and follower are envisioned by the inventors.

The preferred cam member is adapted to move into an opening position wherein the protruding surface is forced against a first portion of the cam arm to force the cam arm in a first direction that opens the floor, and wherein the cam member is adapted to further move the protruding surface away from contact with said first portion of the cam arm so that the floor is closable. Further, the cam member may be further movable into a closing position wherein the protruding surface is forced against a second portion of the cam arm to force said cam arm in a second direction that closes the floor. The cam member is preferably also moveable to a third, neutral position, which may be in between the first and second positions, wherein said cam protruding surface is not urged against any portion of the cam arm, that is, that cam member is not touching or at least not inhibiting movement of the cam arm.

Preferably, a bias member is included for urging the floor closed, so that, when the cam member moves the protruding surface away from contact with said cam arm, the floor automatically closes as a fail-safe feature. Because the preferred cam member is positioned at least partly inside an opening of the cam arm, the cam member may move against the various interior surfaces defining the opening. For example, the cam arm opening's side surfaces may comprise an opening surface and a closing surface (typically but not necessarily parallel and opposite each other). Also, the cam arm preferably has enough space inside the opening for the cam member to move the protruding cam surface away from contact with any of the earn arm surfaces, thus, providing room for the neutral position.

Referring specifically to the Figures, several, but not the only, embodiments of the invention serve to demonstrate these broader concepts.

Referring to FIG. 1, a prior art stove 100 with a sloped wall 101 in the combustion chamber 103 and movable floor 102 is shown. In such a stove 100, the movable floor is preferably the entire floor of the combustion chamber. In other stoves, such as that in FIGS. 2–6, the movable floor 2 is a portion of the floor, for example, a semi-circular section accounting for half of a circular floor.

Figure 2:
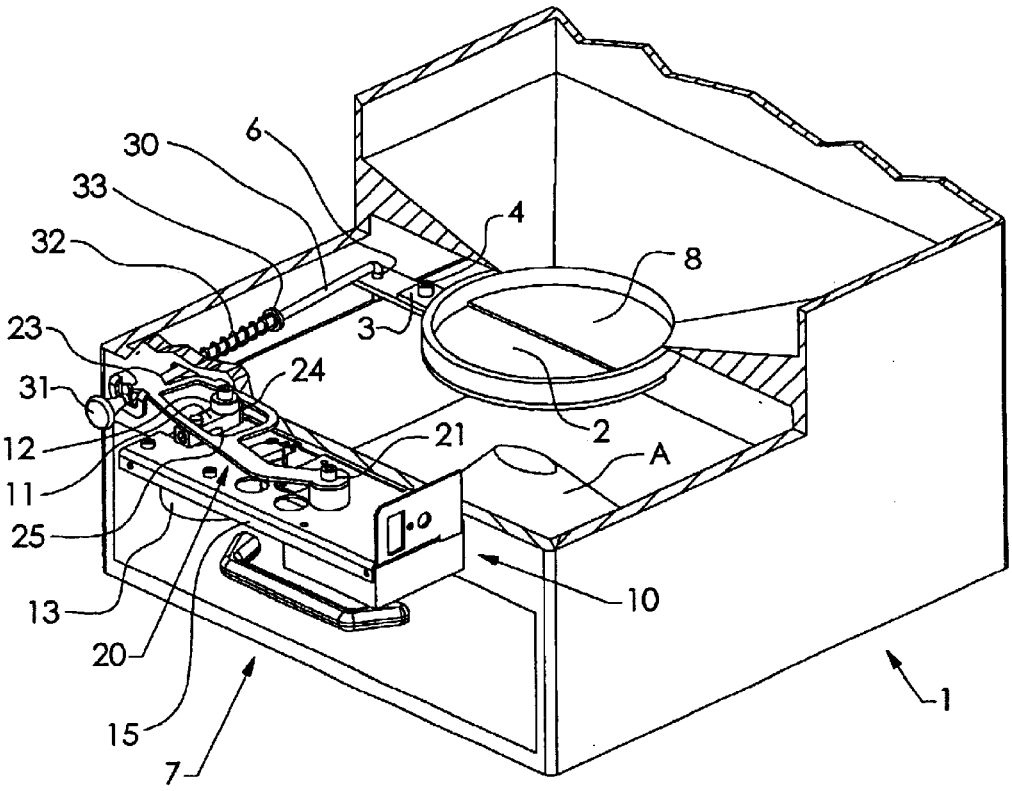
FIG. 2 is a cut-out front perspective view of one embodiment of the invention showing the cam arm and the crank arm both in the closed position on an alternative embodiment of a pellet stove.
Figure 3:
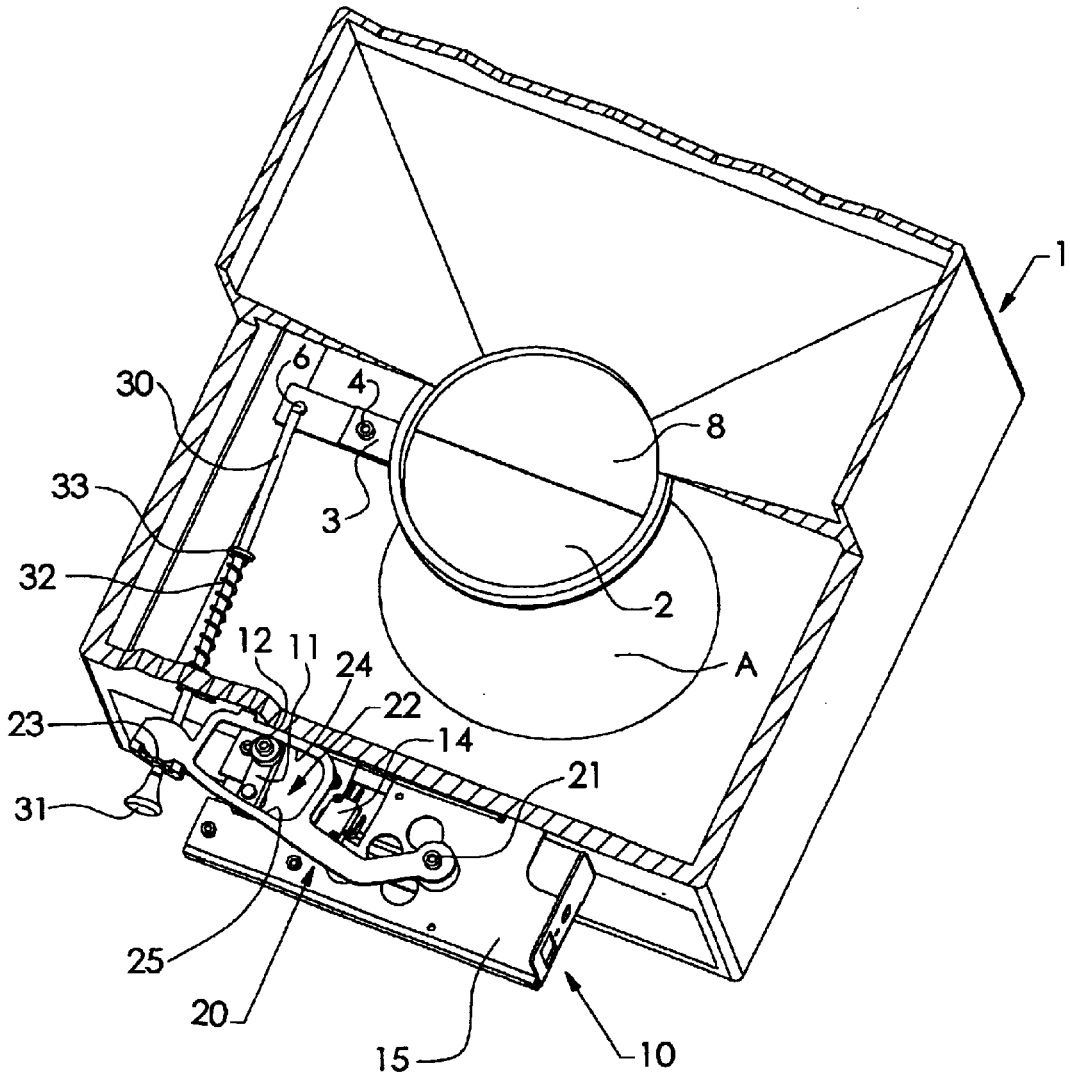
FIG. 3 is a cut-out top perspective view of the embodiment in FIG. 2 showing the cam arm and the crank arm both in the closed position.
Figure 4:
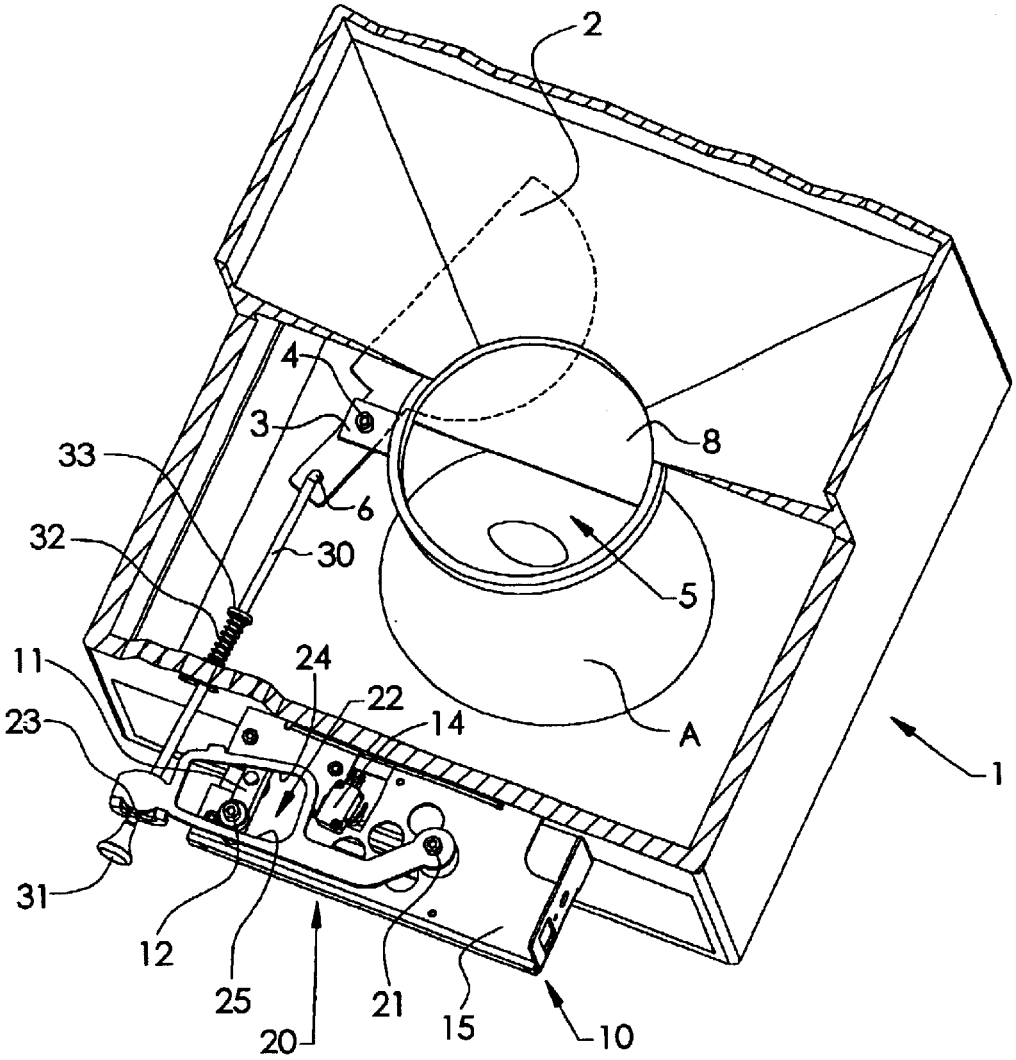
FIG. 4 is a cut-out top perspective view of the embodiment in FIGS. 2 and 3 showing the cam arm and crank arm both in the open position.

As illustrated by FIGS. 2–4, the moveable floor portion 2 pivots around pivot point 4 to uncover/open hole 5 in the bottom of the firepot stove 1. Preferably, fixed floor piece 8 is preferably sloped downward toward pivoting floor 2 to facilitate ash removal, or some other adaptation is made to prevent ash/debris hang-up inside the combustion chamber. The floor 2 has an extending arm 3 and a floor pivot point 4. When the floor 2 is pivotally connected to the attachment member at the pivot point 4, the floor 2 may then be rotated or pivoted in a horizontal plane to create the opening 5 in the bottom of the firepot stove 1. Preferably, the floor pivot point 4 and linkage attachment point 6 are located on the extending arm 3. The linkage attachment point 6 is for connecting the movable floor to the floor opening system 10.

One embodiment of the invented floor opening system 10 for automatically opening and closing said floor 2 is illustrated in FIGS. 2–7. In the preferred embodiment, the floor opening system 10 is positioned substantially outside of the stove 1, but operably connected to the floor 2 via a connection system such as connecting rod 30. Connection rod 30 attaches at one end to the linkage attachment point 6 of the floor 2, and at the other end to the main unit of the floor opening system 10. In many embodiments, the cam arm will be placed so that its longitudinal axis is generally parallel to the longitudinal axis of the floor, with the connection rod extending between the cam arm and floor and having approximately 90 degree connections to both the cam arm and the floor.

The floor opening system 10 automatically operates the movable floor 2 by means of the connection rod's 30 attachment to linkage attachment point 6. Connection rod 30 extends out from under the bottom of the firepot stove 1, to an end of a cam arm 20, preferably out past the cam arm connection point 23 to terminate at a handle 31 on the outer end of the rod 30. The cam arm 20 pivots around a cam arm pivot point 21 near the end of the cam arm 20 not attached to said connecting rod 30. There is a roughly oblong opening 22 in the middle of the cam arm 20 near the connection to said connecting rod 30.

A small reversing electric motor 13 is attached to a crank arm 11, which is located at least partially inside the oblong opening 22. Activating the motor 13 turns the crank arm 20. As the crank arm 20 swings, its distal end comprising a bearing member 12 contacts and pushes the cam arm 20, causing the cam arm 20 to pivot, in turn moving the connecting rod 30 and opening or closing the firepot floor 2. The bearing member 12 is included to provide rolling contact rather than scraping, which reduces friction and wear, extending the useful life of the floor opening system 10. The bearing member 12 may be a bearing, a bushing, or another structure or surface that is adapted to slide along or roll along the surfaces of the cam arm opening.

Figure 5:
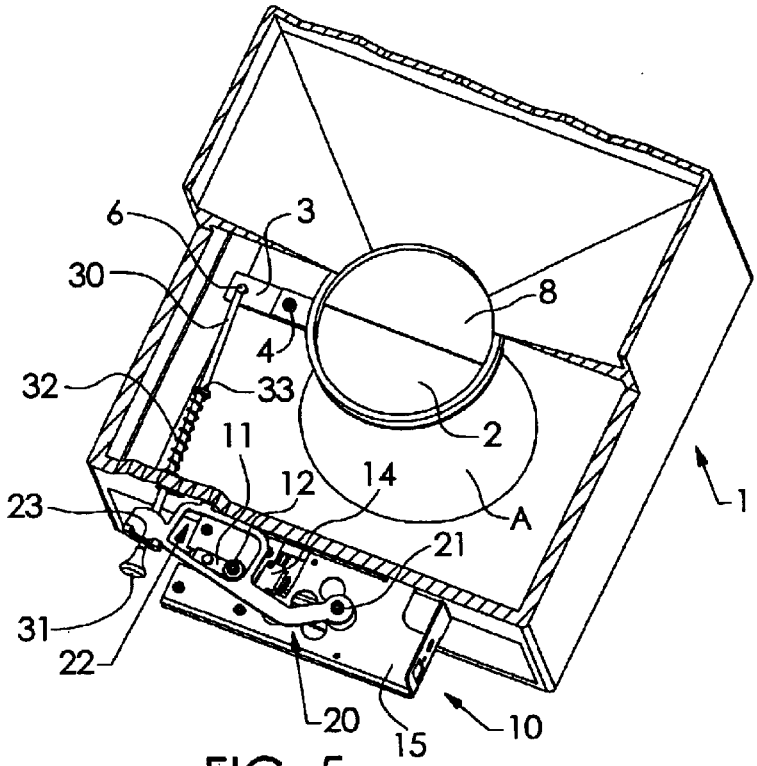
FIG. 5 is a cut-out top perspective view of the embodiment in FIGS. 2, 3, and 4 showing the crank arm in the closed position and the cam arm in the park position.
Figure 6:
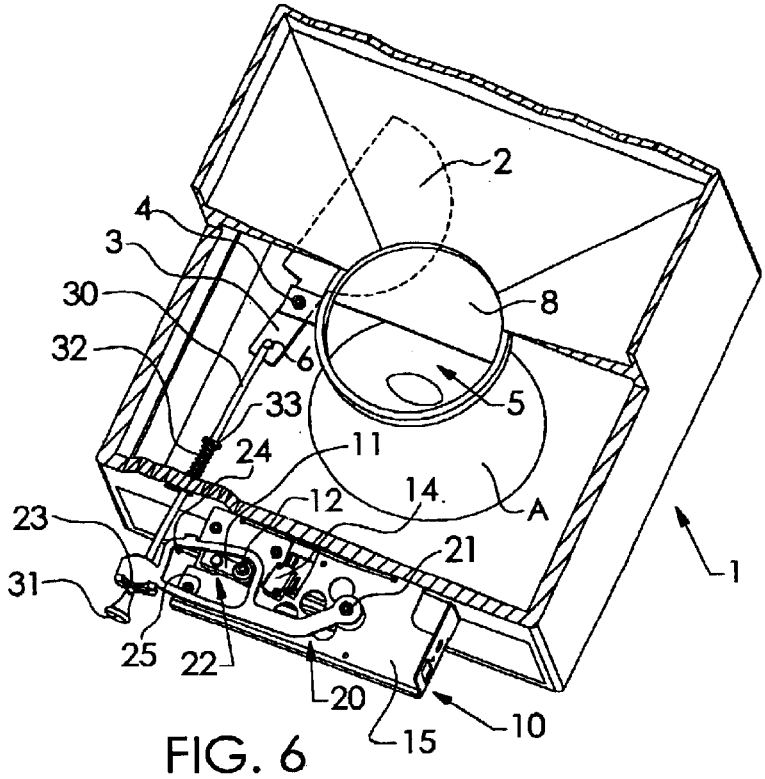
FIG. 6 is a cut-out top perspective view of the embodiment in FIGS. 2, 3, 4, and 5 showing the crank arm in the open position and the cam arm in the park position.
Figure 7:
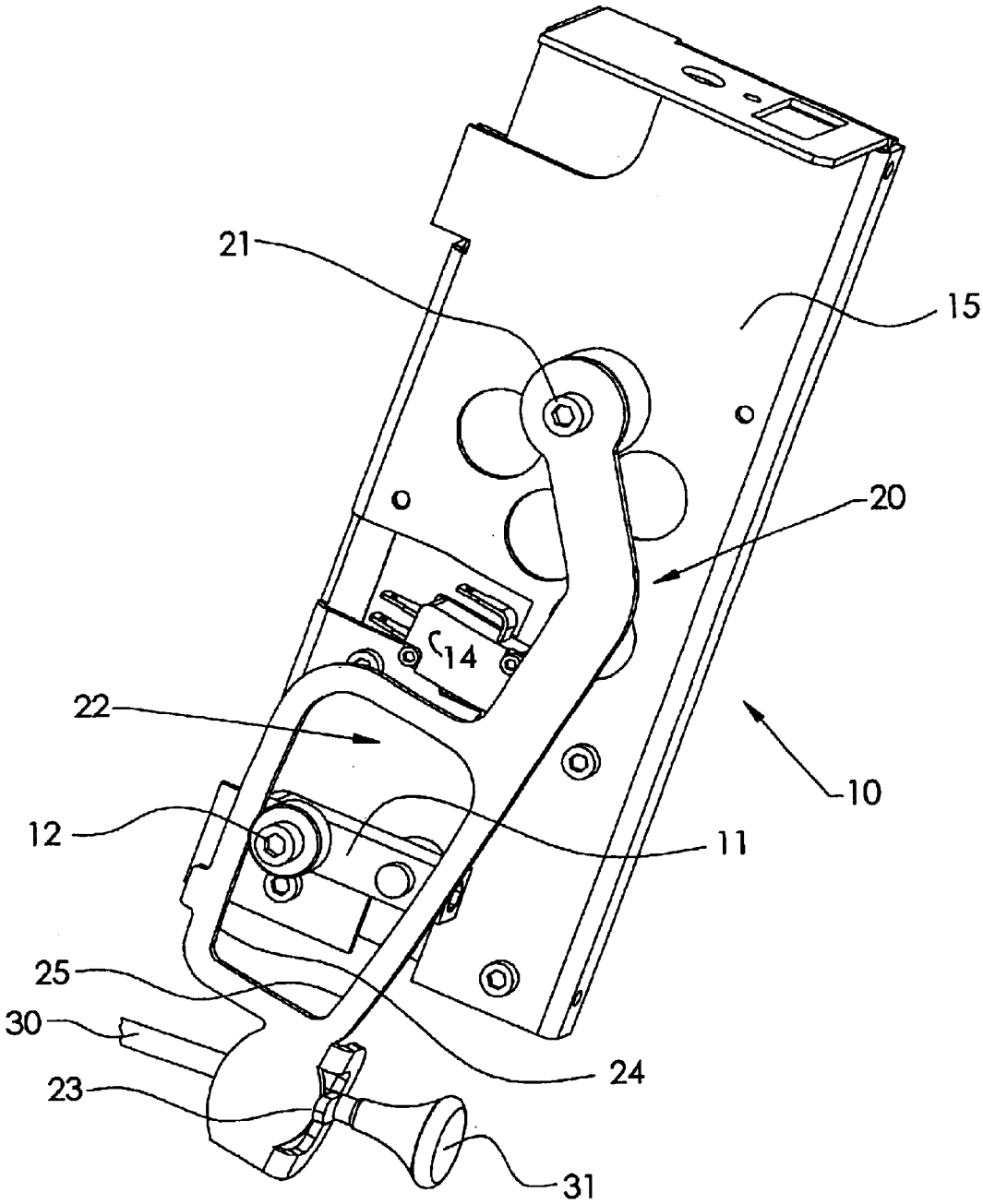
FIG. 7 is a detailed, enlarged view of the floor opening/closing system of FIGS. 2–6.

The crank arm 11 stops in one of three positions: open, closed, and park. Conversely, the cam arm 20 stops in only two positions: open and closed. As shown in FIG. 3, moving the crank arm 11 into the closed position forces the bearing member 12 against the closing surface 24 of the cam arm's oblong opening 22, moving the cam arm 20 into the closed position, in turn closing the stove floor 2. Similarly, moving the crank arm 11 into the open position forces the bearing member 12 against the opening surface 25 of the cam arm's oblong opening 22, moving the cam arm 20 into the open position, in turn opening the stove floor 2, as illustrated by FIG. 4. However, because the crank arm 11 is not attached to the cam arm 20, and the crank arm may therefore be disengaged from the cam arm 20, the cam arm and connecting rod 30 can be manually moved from the open to closed position manually when the crank arm 11 is the park position, as illustrated in FIGS. 5 and 6. This is accomplished by gripping the handle 31 and pushing or pulling. Alternative methods of making the floor manually controllable may be employed, for example, other means of disengaging the cam member from the cam arm, or other unfastening, disengaging or disabling portions of the system to allow manual control.

As illustrated by the drawings, the preferred embodiment includes a spring 32 that applies additional closing force to the connecting rod 30 and biases the floor into the closed position. The spring surrounds the connecting rod 30 and is positioned between the stove wall and a spring stop 33, which is attached to the connecting rod 30. Although the floor opening system 10 is capable of closing the floor 2 without the spring 32, the spring 32 is included in order to help insure that the floor 2 closes completely. The spring 32 supplies a bias that tends to keep the floor closed until the crank arm 11 applies force against the opening surface 25 as it moves into the closed position in FIG. 3. Therefore, the floor 2 stays closed when the crank arm 11 moves into the neutral position. The biasing force of the spring 32 must be overcome to open the door automatically or manually, and the spring 32 automatically returns the floor opening system 10 to the closed position when the handle 31 is released.

In the preferred embodiment, a safety switch 14 is included, which detects when the cam arm 20 is in the closed position. This switch disables the firepot's combustion system whenever the cam arm 20 is not in the closed position. The floor opening system 10 is connected to the stove's temperature control system, and initiates the cleaning sequence after the combustion system shuts down completely.

The preferred embodiment includes a mounting plate 15, to which are attached the motor 13, cam arm 20, and switch 31. These components of the floor opening system 10 are concealed by additional shielding or housing pieces that are not shown so as to better illustrate the working components of the floor opening system 10. The mounting plate 15, housing or shielding pieces, and or other anchoring and structural support members associated with the motor, cam arm, crank arm, and switch may be elements of one embodiment of a mounting system for operatively connecting the floor opening system 10 to the stove. Alternatively, the mounting system may be integral with or inside the stove's other housing/shielding/connection structure, rather than being a separate unit attached to the outside of the stove housing. Therefore, the term "mounting system" in the claims may be of many different embodiments, shapes, and orientations, and is not necessarily limited to a retrofit or separate unit protruding outside the stove housing.

The preferred embodiment of FIGS. 2–7 is shown attached to the front of the firepot stove 1. However, this and other embodiments may be attached to any side of the stove, under the stove, above the stove, or inside the stove. In determining placement of the floor opening and closing system, consideration should be given to the relative positions of the cam arm 20, connection rod 30, linkage attachment point 6, pivot point 4, and floor, so that the cam arm movement will properly translate to movement of the floor. Also, consideration should be given to aesthetics of the outer appearance of the stove, and to proper access of the handle 31 or other manual controls by the user.

The floor opening system 10 may be attached to a variety of control systems (not shown), which would preferably include a timer. After review of this Description and the Drawings, one of average skill in the art would be capable of designing an appropriate control system or of adapting a prior art automatic ash dumping control for use in the instant invention. The control system preferably would also be connected to the safety switch 14 and the stove's combustion control system. The timer would be able to limit the length of burn cycles as appropriate for the fuel being used. Also, the control system would prevent the stove's combustion system from starting up while the floor opening system 10 is operating.

Once the floor has cycled open and closed the desired number of times and the floor is closed, the pellet delivery, ignition and burning may be resumed. Conventional modes of control may be used for the efficient and safe cycling and operation of the stove, including temperature control, sequencing, number of floor openings, pellet delivery control, and safety controls.

The term "cam arm" is used in the description and claims to describe the member against which the cam member moves to open and/or close the floor. The cam arm may be a separate arm that is located a distance from the floor and connected by a long connector. Alternatively, the term cam arm may also include embodiments wherein the cam arm is very close to the floor, or even an integral extension of the floor. The cam arm need not, therefore, be separate from the floor, and need not be an elongated or long member, but may include various members connected to the floor or various portions of the floor that may be acted upon by a cam member surface.

Although this invention has been described above with reference to particular means, materials, and embodiments, it is to be understood that the invention is not limited to these disclosed particulars, but extends instead to all equivalents within the scope of the following claims.

We claim:

1. A floor opening and closing system for an ash-removal floor of a stove, the opening and closing system comprising:

a cam system comprising a cam arm operatively connected to an ash-removal floor of a stove for opening and closing said floor, and a cam member having a protruding surface, wherein the cam member is adapted to move into an opening position wherein the cam member urges the protruding surface against said cam arm to force said cam arm to in a first direction that opens said floor, and wherein the cam member is adapted to further move the protruding surface away from contact with said cam arm so that the floor is closable.

2. A system as in claim 1, further comprising a bias member for urging the floor closed when said cam member moves the protruding surface away from contact with said cam arm.

3. A system as in claim 1, wherein said cam member is further movable to a closing position wherein the cam member urges the protruding surface against said cam arm to force said cam arm in a second direction that closes the floor, and a neutral position wherein said cam protruding surface is not urged against the cam arm.

4. A system as in claim 3, wherein said cam arm is manually movable to open the floor when the cam member is in the neutral position.

5. A system as in claim 1, wherein said cam arm has an opening defined by side surfaces comprising an opening surface and a closing surface, and the opening receive said protruding surface of the cam member so that the protruding surface is moveable in the opening into said opening position, closing position and neutral position.

6. A system as in claim 5, wherein said opening is elongated.

7. A system as in claim 4, wherein said cam arm is connected to the floor by a connector, and said connector has a handle accessible to a user for manually opening and closing said floor.

8. In a stove with a movable ash-dumping floor, a floor opening and closing system comprising:

a mounting system for connecting the floor opening and closing system to the stove;

a motor, a crank arm operatively connected to said motor;

a cam arm with an opening surrounding at least part of said crank arm, the cam arm having a first end pivotally connected to a portion of said mounting means and the cam arm having a second end; and a connection from said cam arm to said ash-dumping floor, wherein said crank arm and said cam arm are sized and positioned such that rotating said crank arm causes said crank arm to engage sides of said opening in said cam arm, which causes said cam arm to pivot around said first end to move said ash-dumping floor.

9. The floor opening and closing system of claim 8, further comprising a rotating member on a distal end of said crank arm that engages said sides of the opening to cause the cam arm to pivot.

10. The floor opening and closing system of claim 8, wherein said rotating member is a bearing.

11. The floor opening and closing system of claim 8, wherein said motor is a reversible electric motor.

12. The floor opening and closing system of claim 8, wherein said connection comprises a connecting rod having a first rod end and a second rod end, the first rod end being pivotally connected to said ash-dumping floor and the second rod end being connected to said second end of said cam arm.

13. The floor opening and closing system of claim 8, comprising an electrical switch that detects whether the floor is closed and is adapted to shut off fuel-loading and combustion systems of the stove whenever the floor is not closed.

14. The floor opening and closing system of claim 13, comprising a timer control system adapted to shut off fuel supply and to initiate opening of the floor at given intervals.

15. The floor opening and closing system of claim 14, wherein said interval is adjustable in length.

16. The floor opening and closing system of claim 8, comprising a handle on said second rod end for manual actuation of said movable floor.

17. The floor opening and closing system of claim 8, comprising a spring system biasing the floor opening and closing system closed.

18. The floor opening and closing system of claim 9, wherein said sides of said opening comprise an opening surface and a closing surface opposite said opening surface, and wherein said rotating member pushes against said opening surface when said crank arm moves away from the ash-dumping floor into a position perpendicular to the opening surface, and wherein said rotating member pushes against said closing surface when said crank arm moves toward the ash-dumping floor into a position perpendicular to the closing surface.

* * * * *